US011761697B2

(12) United States Patent
Kim et al.

(10) Patent No.: US 11,761,697 B2
(45) Date of Patent: Sep. 19, 2023

(54) MULTI-AIR CONDITIONER FOR HEATING AND COOLING OPERATIONS

(71) Applicant: LG ELECTRONICS INC., Seoul (KR)

(72) Inventors: Hyungjoon Kim, Seoul (KR); Junseong Park, Seoul (KR); Daehyoung Kim, Seoul (KR); Yongcheol Sa, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 47 days.

(21) Appl. No.: 17/491,603

(22) Filed: Oct. 1, 2021

(65) Prior Publication Data

US 2022/0107126 A1 Apr. 7, 2022

(30) Foreign Application Priority Data

Oct. 5, 2020 (KR) ..... 10-2020-0127983

(51) Int. Cl.
*F25B 49/02* (2006.01)
*F25B 13/00* (2006.01)
(Continued)

(52) U.S. Cl.
CPC ..... *F25B 49/02* (2013.01); *F25B 13/00* (2013.01); *F25B 31/004* (2013.01); *F25B 43/02* (2013.01);
(Continued)

(58) Field of Classification Search
CPC ..... F25B 49/02; F25B 13/00; F25B 31/004; F25B 43/02; F25B 2313/0231; F25B 2313/0233; F25B 2313/02741
See application file for complete search history.

(56) References Cited

U.S. PATENT DOCUMENTS

2011/0192189 A1* 8/2011 Morimoto ..... F24F 3/06 62/513
2019/0242622 A1 8/2019 Matsuda et al.
2021/0131695 A1 5/2021 Cho et al.

FOREIGN PATENT DOCUMENTS

CN 101329093 12/2008
CN 105723168 6/2016
(Continued)

OTHER PUBLICATIONS

Pdf file is translation of foreign referecne CN109863352A (Year: 2019).*
(Continued)

*Primary Examiner* — Henry T Crenshaw
*Assistant Examiner* — Kamran Tavakoldavani
(74) *Attorney, Agent, or Firm* — KED & ASSOCIATES

(57) ABSTRACT

A multi-air conditioner for heating/cooling operations, including at least one indoor unit for heating/cooling operations including an indoor heat exchanger; and an outdoor unit for heating/cooling operations including a compressor, an outdoor heat exchanger, and a switching unit configured to be disposed in a discharge side of the compressor to switch a flow of refrigerant. The outdoor unit includes a receiver that selectively stores refrigerant or oil according to a cooling or heating operation mode and provides the stored refrigerant or oil to the compressor. Accordingly, in the accumulator of the multi-air conditioner using the receiver, the receiver which is not used in the heating mode may be converted and used for oil storage, thereby preventing oil burnout without adding structure.

15 Claims, 6 Drawing Sheets

(51) Int. Cl.
*F25B 31/00* (2006.01)
*F25B 43/02* (2006.01)

(52) U.S. Cl.
CPC ..... *F25B 2313/0231* (2013.01); *F25B 2313/0233* (2013.01); *F25B 2313/02741* (2013.01)

(56) References Cited

FOREIGN PATENT DOCUMENTS

| | | | | | |
|---|---|---|---|---|---|
| CN | 109863352 | A * | 6/2019 | ..... | F25B 1/04 |
| CN | 111133258 | | 5/2020 | | |
| EP | 3 534 086 | | 9/2019 | | |
| KR | 10-2003-0026627 | | 4/2003 | | |
| KR | 10-2014-0018536 | | 2/2014 | | |
| KR | 10-2019-0088692 | | 7/2019 | | |
| WO | WO 2019/143195 | | 7/2019 | | |
| WO | WO-2019143195 | A1 * | 7/2019 | ..... | F24F 11/70 |

OTHER PUBLICATIONS

Pdf file is translation of foreign referecne WO2019143195A1 (Year: 2019).*
Pdf is translation of foreign reference (Year: 2019).*
European Search Report dated Feb. 21, 2022 issued in EP Application No. 21200396.6.
Chinese Office Action issued in Application No. 202111159433.8 dated Feb. 16, 2023.

* cited by examiner

MULTI-AIR CONDITIONER FOR HEATING AND COOLING OPERATIONS

CROSS-REFERENCE TO RELATED APPLICATION

This application claims priority under 35 U.S.C. § 119 to Korean Patent Application No. 10-2020-0127983 filed on Oct. 5, 2020, whose entire disclosure is hereby incorporated by reference.

BACKGROUND OF THE INVENTION

1. Field of the Invention

The present disclosure relates to a multi-air conditioner for heating/cooling operation, and more particularly, to a multi-air conditioner for heating/cooling operation capable of resolving a lack of oil in a compressor during heating in a cold region.

2. Description of the Related Art

In general, a multi-type air conditioner is an air conditioner that connects a plurality of indoor units to a single outdoor unit, and uses each of the plurality of indoor units as a cooler or a heater while using the outdoor unit in common.

Recently, a plurality of outdoor units are connected in parallel to each other and used to effectively respond to a cooling or heating load according to the number of operating indoor units.

A multi-air conditioner according to the related art includes a plurality of outdoor units, a plurality of indoor units, and a refrigerant pipe connecting the plurality of outdoor units and the plurality of indoor units. Here, the plurality of outdoor units include a main outdoor unit and a plurality of sub-outdoor units.

Each of the plurality of outdoor units includes a compressor that compresses a gaseous refrigerant of low temperature and low pressure to be a high temperature and high pressure refrigerant, an outdoor heat exchanger for heat-exchanging the circulated refrigerant with outdoor air, and a four-way valve that switches refrigerant flow according to cooling or heating operation. Each of the plurality of indoor units includes an expansion device, and an indoor heat exchanger that heat-exchanges the circulated refrigerant with indoor air.

In the multi-air conditioner according to the related art configured as described above, during the cooling operation, the refrigerant compressed by the compressor of the main outdoor unit and the sub outdoor unit is transferred to the outdoor heat exchanger by the four-way valve, the refrigerant passing through the outdoor heat exchanger is condensed by heat exchange with ambient air, and then transferred to the expansion device. The refrigerant expanded by the expansion device flows into the indoor heat exchanger and evaporates while absorbing heat from the indoor air, thereby cooling the room.

Meanwhile, during the heating operation, a flow path is switched in the four-way valve, and the refrigerant discharged from the compressor sequentially passes through the four-way valve, an indoor heat exchanger, an outdoor linear expansion valve (LEV), and an outdoor heat exchanger, thereby heating the room.

As an example, in Korea Patent Publication No. KR20140018536A, even if a heating/cooling mode is switched, the number of non-operating indoor units is changed, or the operating condition is changed, e.g. the indoor/outdoor temperature is changed, a system efficiency can be optimized to operate by using a receiver to optimize the refrigerant circulation amount. However, the related art only describes the controlling of the circulation amount of the refrigerant, but does not mention the lack of oil at all.

In addition, Korean Patent Publication No. KR20010059700A discloses a technology for circulating oil back to the compressor and sending only the refrigerant to a condenser through an oil separator that separates the oil and the refrigerant discharged from the compressor.

However, such an oil separation technology only separates the refrigerant and the oil, and does not recognize at all the impossibility of separation when the temperature of the oil and the refrigerant is very low in an initial operation.

In particular, in a case where the external temperature is very low as in a cold region, when performing a heating operation that limits a low pressure as shown in FIG. 1, as an example, when it is driven by one compressor, and the driving frequency is 30 Hz, if the oil temperature and oil superheat does not rise in a short time, and the superheat of the oil is not secured, the oil, which should form an appropriate oil level inside the compressor, is swept away together with the refrigerant in the initial operation. Therefore, the lowest oil level is not secured, and there is a risk that the compressor may be damaged by a fire due to the lack of oil performing a lubricating role.

SUMMARY OF THE INVENTION

A first object of the present disclosure is to provide a structure capable of storing oil in an accumulator of a multi-air conditioner for heating/cooling operation using a receiver.

A second object of the present disclosure is to provide a multi-air conditioner for heating/cooling operation capable of replenishing oil that may be insufficient and storing the oil in a receiver by performing an oil recovery operation during a heating operation in a low temperature neglected state.

A third object of the present disclosure is to provide a multi-air conditioner for heating/cooling operation capable of actively performing a recovery operation according to the current state of the air conditioner by periodically checking the outdoor temperature and the compressor water level and performing an oil recovery operation accordingly.

In accordance with an aspect of the present disclosure, a multi-air conditioner for heating/cooling operation includes: at least one of indoor units for heating/cooling operation including an indoor heat exchanger respectively; and an outdoor unit for heating/cooling operation including a compressor, an outdoor heat exchanger, and a switching unit configured to be disposed in a discharge side of the compressor to switch a flow of refrigerant, wherein the outdoor unit for heating/cooling operation includes a receiver which selectively stores refrigerant or oil according to a cooling or heating operation mode and provides the stored refrigerant or oil to the compressor.

The receiver stores the refrigerant in the cooling operation mode, and stores the oil in the heating operation mode.

The outdoor unit for heating/cooling operation further includes a receiver oil recovery pipe connecting the receiver and an output terminal of the compressor; and an oil recovery valve which is disposed on the receiver oil recovery pipe, and opened and closed to recover the oil in the compressor to the receiver.

The oil recovery valve is a solenoid valve.

The outdoor unit for heating/cooling operation further includes an accumulator which is connected to the receiver and transfers the refrigerant or oil to the compressor.

The multi-air conditioner further includes a receiver outlet pipe connecting the receiver and the accumulator; and a receiver inlet pipe for transferring the refrigerant to the receiver, wherein a receiver outlet valve is formed on the receiver outlet pipe and a receiver inlet valve is formed on the receiver inlet pipe, respectively.

The receiver receives and stores the oil from the compressor in an oil recovery operation after a heating operation is terminated.

The oil recovery operation is performed only when an outdoor temperature is less than a first threshold value after the heating operation is terminated.

The first threshold value is a value lower than minus 20 degrees.

In the oil recovery operation, the oil recovery valve is opened, and the receiver outlet valve and the receiver inlet valve are closed to provide the oil of the compressor to the receiver.

An oil level sensor for detecting a level of the oil is formed inside the compressor.

The level sensor for detecting a level of the oil or refrigerant is formed in the receiver.

When the heating operation starts, the oil of the receiver is provided to the compressor at a start of the compressor.

Meanwhile, in accordance with another aspect of the present disclosure, a method of controlling a multi-air conditioner for heating/cooling operation, includes: receiving a heating operation start signal; reading an outdoor temperature and an oil level value of a compressor and determining whether the compressor is short of oil; supplying stored oil from a receiver to the compressor to increase an oil level of the compressor, when it is determined that the oil in the compressor is insufficient; and stopping the supply of oil from the receiver and performing a heating operation, when the oil level value of the compressor is greater than a threshold value.

The method further includes performing an oil recovery operation of recovering the oil to the receiver according to the outdoor temperature, when the heating operation is terminated.

The oil recovery operation is performed when the heating operation is terminated and the outdoor temperature is lower than a first threshold value.

When the outdoor temperature is lower than the first threshold value and the oil level of the compressor is lower than a certain level, it is determined that the oil is insufficient, and the oil stored in the receiver is transferred to the compressor.

BRIEF DESCRIPTION OF THE DRAWINGS

The above and other objects, features and advantages of the present disclosure will be more apparent from the following detailed description in conjunction with the accompanying drawings, in which.

DETAILED DESCRIPTION OF THE PREFERRED EMBODIMENTS

Figure 1:
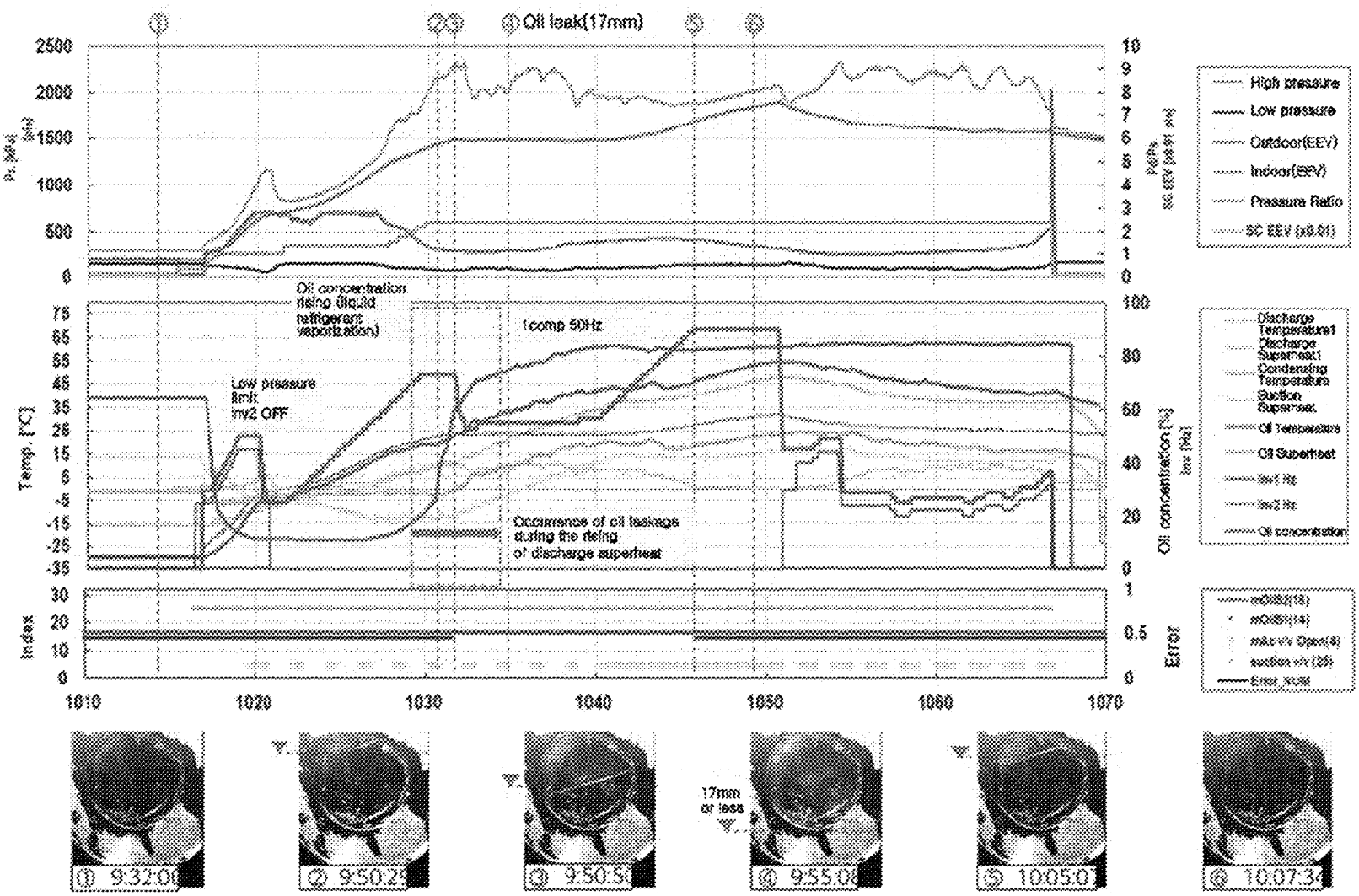
FIG. 1 is a graph illustrating conventional oil burnout.

Advantages and features of the present disclosure and methods of achieving them will become apparent with reference to the embodiments described below in detail in conjunction with the accompanying drawings. However, the present disclosure is not limited to the embodiments disclosed below, but may be implemented in various different forms, and these embodiments are provided only to allow the disclosure of the present disclosure to be complete, and to completely inform those of ordinary skill in the art to which the present disclosure belongs, the scope of the invention, and the present disclosure is only defined by the scope of the claims. Like reference numerals refer to like elements throughout.

The terms spatially relative, "below", "beneath", "lower", "above" and "upper" and the like can be used to easily describe the correlation of elements with other elements. Spatially relative terms should be understood in terms of the directions shown in the drawings, including the different directions of components at the time of use or operation. For example, when inverting an element shown in the drawings, an element described as "below" or "beneath" of another element may be placed "above" of another element. Thus, the exemplary term "below" may include both downward and upward directions. The elements may also be oriented in a different direction, so that spatially relative terms can be interpreted according to orientation.

The terminology used herein is for the purpose of illustrating embodiments and is not intended to restrict the invention. In this specification, singular forms include plural forms unless the context clearly dictates otherwise. It is noted that the terms "comprises" and/or "comprising" used in the specification mean that mentioned elements, steps, and/or operations do not exclude the presence or addition of one or more of other elements, steps, and/or operations.

Unless defined otherwise, all terms (including technical and scientific terms) used herein may be used in a sense commonly understood by a person having ordinary skill in the art to which the claimed invention pertains. In addition, commonly used predefined terms are not ideally or excessively interpreted unless explicitly defined otherwise.

In the drawings, the thicknesses and sizes of respective elements are exaggerated, omitted, or schematically shown for convenience and clarity of explanation. In addition, the size and area of each element do not entirely reflect actual size or area.

Hereinafter, a preferred embodiment of the present disclosure will be described with reference to the accompanying drawings.

Figure 2:
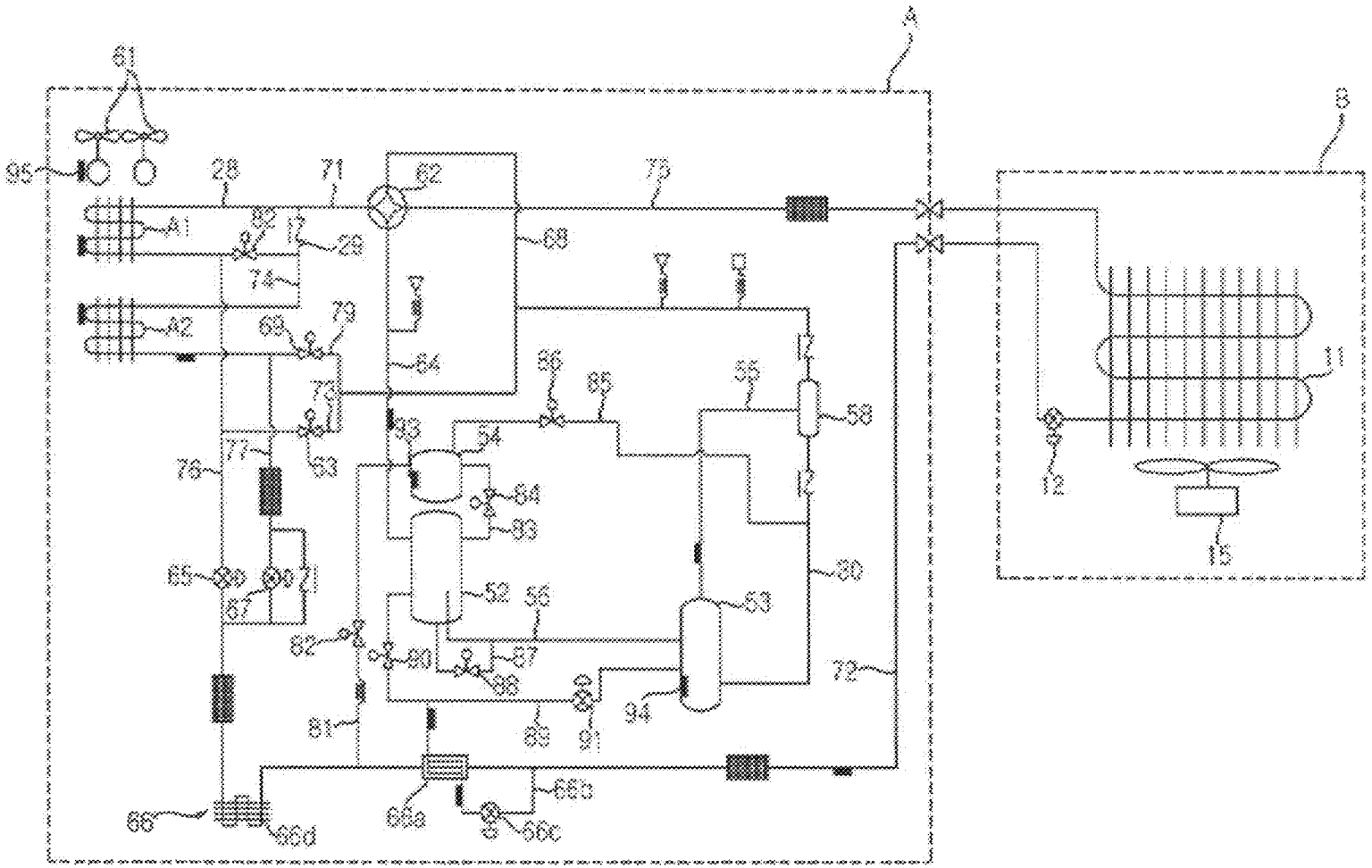
FIG. 2 is a schematic configuration diagram of a multi-air conditioner for heating/cooling operation according to an embodiment of the present disclosure.

FIG. 2 is a schematic configuration diagram of a multi-air conditioner for heating/cooling operation according to an embodiment of the present disclosure.

Referring to FIG. 2, a multi-air conditioner for heating/cooling operation 100 according to an embodiment of the present disclosure is illustrated. The multi-air conditioner for heating/cooling operation 100 includes at least one of indoor units B for heating/cooling operation and an outdoor unit A for heating/cooling operation.

The outdoor unit A for heating/cooling operation includes at least one of compressors 53, an outdoor heat exchanger A1, A2, an outdoor heat exchanger fan 61, a hot gas unit 73, 75, a supercooling unit 66, and a switching unit. Here, the switching unit includes a four-way valve 62. A suction portion of the at least one of compressors 53 is connected by an accumulator 52. The compressor 53 may be an inverter compressor capable of controlling the amount of refrigerant and the discharge pressure of the refrigerant by adjusting the operating frequency. In addition, it may further include a constant speed compressor, but is not limited thereto.

A discharge pipe 55 is connected to a discharge portion of the compressor 53, and an oil separator 58 is installed in the discharge pipe 55 so as to recover oil from the refrigerant discharged from the compressor 53. An oil recovery pipe 30 is connected to the oil separator 58, and guides the oil separated from the oil separator 58 to the suction portion of the compressor 53.

An oil level sensor 94 for detecting the level of the oil in the compressor 53 and transmitting a corresponding detection signal to the control unit may be formed inside the compressor 53.

The hot gas unit 73, 75 for bypassing the refrigerant discharged from the compressor 53 without passing through the four-way valve 62 are connected to the discharge pipe 55. In addition, the discharge pipe 55 is connected to the four-way valve 62 by a third discharge pipe 68.

An oil recovery structure capable of recovering oil to the compressor 53 may be disposed in the accumulator 52. An oil recovery pipe 87 connecting the lower side of the accumulator 52 and an accumulator discharge pipe 56, and an oil return valve 88 which is disposed in the oil recovery pipe 87 to control the flow of oil may be disposed.

The outdoor heat exchanger A1, A2 is connected to the four-way valve 62 by a first connection pipe 71. In the outdoor heat exchanger A1, A2, the refrigerant is condensed or evaporated by heat exchange with the outside air. At this time, in order to easily perform heat exchange, the outdoor fan 61 introduces air into the outdoor heat exchanger A1, A2. In the multi-air conditioner for heating/cooling operation 100, the outdoor heat exchanger A1, A2 is used as a condenser during the cooling operation, and the outdoor heat exchanger A1, A2 is used as an evaporator during the heating operation.

The outdoor heat exchanger A1, A2 is connected to an outdoor heat exchanger-four-way valve connection pipe 71 for flowing the refrigerant between the four-way valve 62 and the outdoor heat exchanger A1, A2. The outdoor heat exchanger-four-way valve connection pipe 71 includes a first outdoor heat exchanger-four-way valve connection pipe 28 connecting the first outdoor heat exchanger A1 and the four-way valve 62, and a second outdoor heat exchanger-four-way valve connection pipe 29 connecting the second outdoor heat exchanger A2 and the four-way valve 62. The outdoor heat exchanger-four-way valve connection pipe 71 connected from the four-way valve 62 is branched into the first outdoor heat exchanger-four-way valve connection pipe 28 and the second outdoor heat exchanger-four-way valve connection pipe 29.

A check valve is disposed in the second outdoor heat exchanger-four-way valve connection pipe 29, and the check valve blocks the inflow of the refrigerant supplied from the outdoor heat exchanger-four-way valve connection pipe 71 from flowing into the second outdoor heat exchanger-four-way valve connection pipe 29.

A variable pass pipe connecting a first outdoor heat exchanger pipe 76 and a second outdoor heat exchanger-four-way valve connection pipe 29 may be further disposed, and a variable pass valve 82 may be further disposed in the variable pass pipe.

The variable pass valve 82 may be selectively operated. When the variable pass valve 82 is opened, the refrigerant flowing along the first outdoor heat exchanger pipe 76 may pass through the variable-pass pipe and the variable-pass valve 82, and may be guided to the four-way valve 62.

When the variable pass valve 82 is closed, the refrigerant supplied through the first outdoor heat exchanger pipe 76 flows to the first outdoor heat exchanger A1, during the heating operation.

When the variable pass valve 82 is closed, the refrigerant that passed through the first outdoor heat exchanger A1 flows to a liquid connection pipe 72 through the first outdoor heat exchanger pipe 76, during the cooling operation.

The outdoor expansion valve 65, 67 expands the refrigerant flowing into the outdoor heat exchanger A1, A2 during the heating operation. During the cooling operation, the outdoor expansion valve 65, 67 pass through the refrigerant while not expanding it. An electronic expansion valve (EEV) capable of adjusting an opening value according to an input signal may be used as the outdoor expansion valve 65, 67.

The outdoor expansion valve 65, 67 includes a first outdoor expansion valve 65 that expands the refrigerant flowing into the first outdoor heat exchanger A1, and a second outdoor expansion valve 67 that expands the refrigerant flowing into the second outdoor heat exchanger A2.

The first outdoor expansion valve 65 and the second outdoor expansion valve 67 are connected to the liquid pipe connection pipe 72. During the heating operation, the refrigerant condensed in the indoor unit B is supplied to the first outdoor expansion valve 65 and the second outdoor expansion valve 67.

In order to be connected to the first outdoor expansion valve 65 and the second outdoor expansion valve 67, the liquid pipe connection pipe 72 is branched, and is connected to each of the first outdoor expansion valve 65 and the second outdoor expansion valve 67. The first outdoor expansion valve 65 and the second outdoor expansion valve 67 are disposed in parallel.

A pipe connecting the first outdoor expansion valve 65 and the first outdoor heat exchanger A1 is defined as a first outdoor heat exchanger pipe 76. A pipe connecting the second outdoor expansion valve 66 and the second outdoor heat exchanger A2 is defined as a second outdoor heat exchanger pipe 77.

The accumulator 52 provides refrigerant to the compressor 53. The accumulator 52 is disposed in the suction side of the compressor 53 and is connected to the four-way valve 62.

The outdoor unit A according to the present embodiment may further include a receiver 54. The receiver 54 may store liquid refrigerant to control the amount of circulated refrigerant. The receiver 54 stores liquid refrigerant separately from storing liquid refrigerant in the accumulator 52.

The receiver 54 supplies the refrigerant to the accumulator 52 when the amount of the circulated refrigerant is insufficient, and collects and stores the refrigerant when the amount of the circulated refrigerant is large.

In addition, the receiver 54 of the outdoor unit A according to the embodiment of the present disclosure may store oil to adjust the amount of oil provided to the compressor 53. The receiver 54 may provide the stored oil to the compressor 53 through the accumulator 52.

That is, the receiver 54 supplies oil to the accumulator 52 when the amount of oil in the compressor 53 is insufficient. Further, when the compressor does not operate, that is, when the air conditioner 100 does not operate, the receiver 54 performs an oil recovery operation, so that the oil in the compressor 53 is recovered and stored into the receiver 54.

Therefore, when most of the operation mode is a heating operation in a cold region where the outdoor air is a certain temperature or less, the refrigerant is hardly stored in the receiver 54, so that the receiver 54 does not serve as a refrigerant storage tank. At this time, the existing installed tank can be diverted as an oil recovery tank by utilizing the receiver 54 as an oil storage tank.

Meanwhile, a pipe connecting the outdoor expansion valve 65, 67 and the supercooling unit 66 among the liquid pipe connection pipe 72 may be classified and defined as a supercooling liquid pipe connection pipe.

The four-way valve 62 is provided in the outlet side of the compressor 53 and switches the flow path of the refrigerant flowing in the outdoor unit A. The four-way valve 62 appropriately switches the flow path of the refrigerant discharged from the compressor 53 in accordance with the cooling/heating operation of the air conditioner 100.

The four-way valve 62 according to this embodiment sends the refrigerant discharged from the compressor 53 to the outdoor heat exchanger A1, A2, sends the refrigerant flowing in the outdoor heat exchanger A1, A2, to the compressor 53 through the accumulator 52, sends the refrigerant discharged from the compressor 53 to a gas pipe 75, or sends the refrigerant introduced from the gas pipe connection pipe 75 to the compressor 53 through the accumulator 52.

In addition, during the heating operation, the four-way valve 62 in the side of the outdoor unit for heating operation sends the refrigerant introduced into the outdoor heat exchanger A1, A2 to the compressor 53.

The air conditioner 100 according to the present embodiment may include a hot gas unit 73, 79 in which a portion of the refrigerant compressed in the compressor 53 flows. A portion of the high-temperature high-pressure refrigerant compressed in the compressor 53 may be introduced into the outdoor heat exchanger A1, A2 through the hot gas bypass pipe 73, 79.

The hot gas unit 73, 79 includes a hot gas valve 63, 69 and a hot gas bypass pipe 73 and 79 for bypassing the refrigerant.

In the present embodiment, a first hot gas bypass pipe 73 connecting the first outdoor heat exchanger pipe 76 and the discharge pipe 55 of compressor is disposed. One end of the first hot gas bypass pipe 73 is connected to the first outdoor heat exchanger pipe 76, and the other end is connected to the compressor discharge pipe 55. A second hot gas bypass pipe 79 connecting the second outdoor heat exchanger pipe 77 and the discharge pipe 55 of compressor is disposed. One end of the second hot gas bypass pipe 79 is connected to the first outdoor heat exchanger pipe 77, and the other end is connected to the discharge pipe 55 of compressor.

A first hot gas valve 63 is disposed in the first hot gas bypass pipe 73, and a second hot gas valve 69 is disposed in the second hot gas bypass pipe 79. A solenoid valve capable of adjusting the opening degree is used as the hot gas valve 63, 69, or an opening/closing valve may be used as well.

The first hot gas bypass pipe 73 and the second hot gas bypass pipe 79 may be connected to the discharge pipe 55 of compressor respectively, but in the present embodiment, after converging, may be connected to the discharge pipe 55 of compressor through a single pipe.

The supercooling unit 66 may be disposed in the liquid pipe connection pipe 72.

The supercooling unit 66 includes a supercooling heat exchanger 66*a*, a supercooling bypass pipe 66*b* that is bypassed in the liquid pipe connection pipe 72 and is connected to the supercooling heat exchanger 66*a*, a supercooling expansion valve 66*c* that is disposed in the supercooling bypass pipe 66*b* and selectively expands the flowing refrigerant, a supercooling-compressor connection pipe 89 connecting the supercooling heat exchanger 66*a* and the compressor 53, and a supercooling-compressor expansion valve 91 that is disposed in the supercooling-compressor connection pipe 89 and selectively expands the flowing refrigerant.

The supercooling unit 66 according to the present embodiment further includes an accumulator bypass pipe connecting the accumulator 52 and the supercooling-compressor connection pipe, and the accumulator bypass pipe provides the refrigerant of the accumulator 52 to the supercooling-compressor connection pipe 89.

A supercooling bypass valve 90 is further disposed in the accumulator bypass pipe.

The supercooling expansion valve 66*c* expands the liquid refrigerant and provides to the supercooling heat exchanger 66*a*, and the expanded refrigerant is evaporated in the supercooling heat exchanger 66*a* to cool the supercooling heat exchanger 66*a*. The liquid refrigerant flowing to the outdoor heat exchanger A1, A2 through the liquid pipe connection pipe 72 may be cooled while passing through the supercooling heat exchanger 66*a*. The supercooling expansion valve 66*c* is selectively operated and may control the temperature of the liquid refrigerant.

When the supercooling expansion valve 66*c* is operated, the supercooling-compressor expansion valve 91 is opened and the refrigerant flows to the compressor 53.

The subcooling expansion valve 66*c* is selectively operated, and may provide the liquid refrigerant of the accumulator 52 to the subcooling-compressor expansion valve 91.

The supercooling-compressor expansion valve 91 is selectively operated, and expands the refrigerant to lower the temperature of the refrigerant supplied to the compressor 53. When the compressor 53 exceeds a normal operating temperature range, the refrigerant expanded by the supercooling-compressor expansion valve 91 may be evaporated in the compressor 53, thereby lowering the temperature of the compressor 53.

The supercooling unit 66 according to the present embodiment further includes a receiver inlet pipe 81 connecting the receiver 54 and the liquid pipe connection pipe 72, and the receiver inlet pipe 81 further includes a receiver inlet valve 82 for providing the refrigerant of the receiver 54 to the liquid pipe connection pipe 72.

Meanwhile, an outlet pipe 83 of the receiver 54 is connected to the accumulator 52, and a receiver outlet valve 84 for providing refrigerant and/or oil to the accumulator 52 is formed on the receiver outlet pipe 83.

The receiver 54 further includes a receiver oil recovery pipe 85 in between the oil recovery pipe 30 and the receiver 54 so as to recover oil of the compressor 53.

In the receiver oil recovery pipe 85, an oil recovery valve 86 is formed to recover all the oil existing in the compressor 53 and the oil separator 58 during the oil recovery operation and store the recovered oil in the receiver 54.

The oil recovery valve 86 may be a solenoid valve, but is not limited thereto.

The air conditioner 100 according to the present embodiment may further include a pressure sensor for measuring the pressure of the refrigerant, a temperature sensor for measuring the temperature of the refrigerant, and a strainer for removing foreign substances existing in the refrigerant flowing through the refrigerant pipe.

Meanwhile, each of the indoor units B for heating/cooling operation includes an indoor heat exchanger 11, an indoor electronic expansion valve 12, and indoor unit fans 15. The indoor electronic expansion valve 12 is installed on the indoor connection pipe connecting the indoor heat exchanger 11 and the gas pipe connection pipe or the liquid pipe connection pipe.

In addition, temperature sensors may be installed to detect the temperature of the refrigerant discharged from the indoor units B for heating/cooling operation. In addition, a temperature sensor (not shown) for measuring the indoor temperature may be installed in the indoor heat exchanger 11.

The multi-air conditioner for heating/cooling operation may further include a distributor in between the outdoor unit and indoor unit of FIG. 2.

When a distributor is included, simultaneous operation or individual operation of a plurality of outdoor units and a plurality of indoor units is possible.

Hereinafter, with reference to FIG. 3, an operation of the multi-air conditioner for heating/cooling operation shown in FIG. 1 and the flow of the refrigerant according to the operation will be described.

Figure 3:
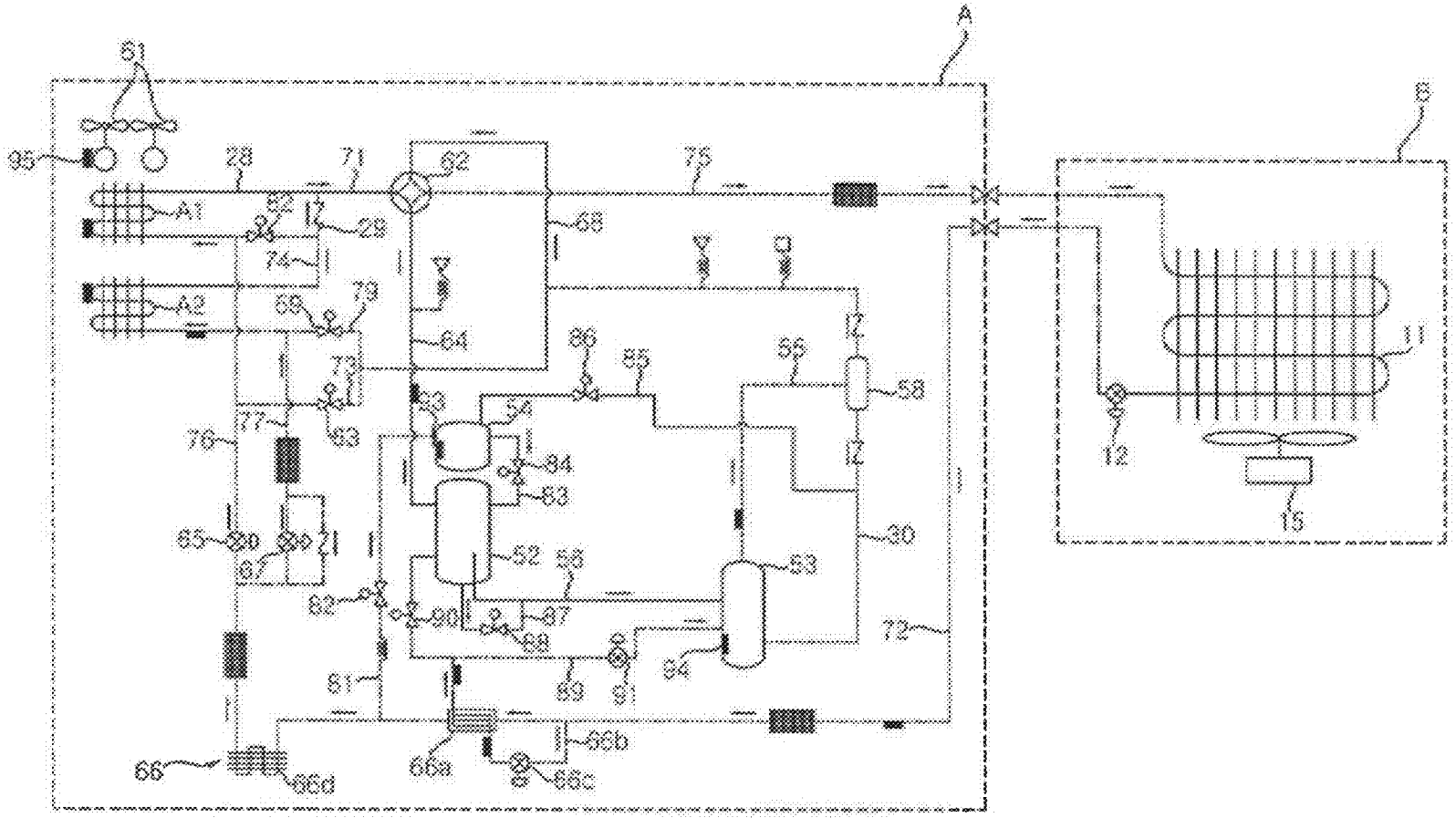
FIG. 3 is an operation diagram illustrating an operating state of the multi-air conditioner for heating/cooling operation of FIG. 1 during a heating operation.

FIG. 3 shows operation of the multi-air conditioner for heating/cooling operation 100 and the flow of the refrigerant during the heating operation. The high-pressure gas refrigerant discharged from the compressor 53 flows through the discharge pipe 55, flows into the four-way valve 62, passes through the high-pressure gas pipe 63, and flows into the indoor unit B. The high-pressure gas refrigerant heats a room while being condensed in the indoor heat exchangers 11. Thereafter, the condensed refrigerant is discharged through the liquid pipe connection pipe 72, expanded in the outdoor electronic expansion valve 65, 67, and then evaporated in the outdoor heat exchanger A1, A2. The low-temperature low-pressure gas refrigerant flows into the suction pipe 64 through the four-way valve 62, and then is sucked into the compressor 53 through the accumulator 52.

Meanwhile, in the case of cooling operation, although not shown, the refrigerant of the high-pressure high-temperature gas discharged from the compressor 53 flows through the discharge pipe 55, passes through the four-way valve 62, passes through the first connection pipe 28, and flows into the first heat exchanger A1 of the outdoor unit A. At this time, a variable pass valve 27 is opened so that the first heat exchanger A1 and the second heat exchanger A2 are connected in series with each other so that the refrigerant flowing through the first heat exchanger A1 performs heat exchange again in the second heat exchanger A2 and is further condensed. The condensed high-pressure liquid refrigerant flows into the indoor unit B through the supercooling unit 66, the refrigerant discharged through the liquid pipe connection pipe 72 is expanded in the indoor electronic expansion valve 12, and then is evaporated in indoor heat exchangers 11, flows into the outdoor unit A as a low-temperature low-pressure gas state, and then is sucked into the compressor 53 through the accumulator 52.

In the operation of such a multi-air conditioner for heating/cooling operation, the receiver serves to adjust the amount of refrigerant.

In such a refrigerant, a larger amount of refrigerant flows during the heating operation than during the cooling operation.

Therefore, the residual refrigerant not used in the receiver is stored during the cooling operation and supplemented during the heating operation to control the flow rate.

That is, during the heating operation, the refrigerant does not remain in the receiver, and the function of the receiver as a refrigerant tank is excluded.

Meanwhile, the operation of the multi-air conditioner for heating/cooling operation in a low-temperature area where the outside temperature is maintained at minus 20 degrees Celsius or less, such as a cold region, is mostly dependent on the heating operation.

The outdoor unit is left outside at a low temperature, and thus the oil superheat is not secured, so that the oil level inside the compressor becomes lower than the lowest oil level at the initial start of the heating operation.

Accordingly, in order to prevent this, the air conditioner of the present disclosure performs an oil recovery operation at the time when the heating operation is terminated, thereby performing an operation for recovering and storing the oil in the compressor and the oil separator in the receiver.

Hereinafter, an oil recovery operation will be described with reference to FIG. 4.

Figure 4:
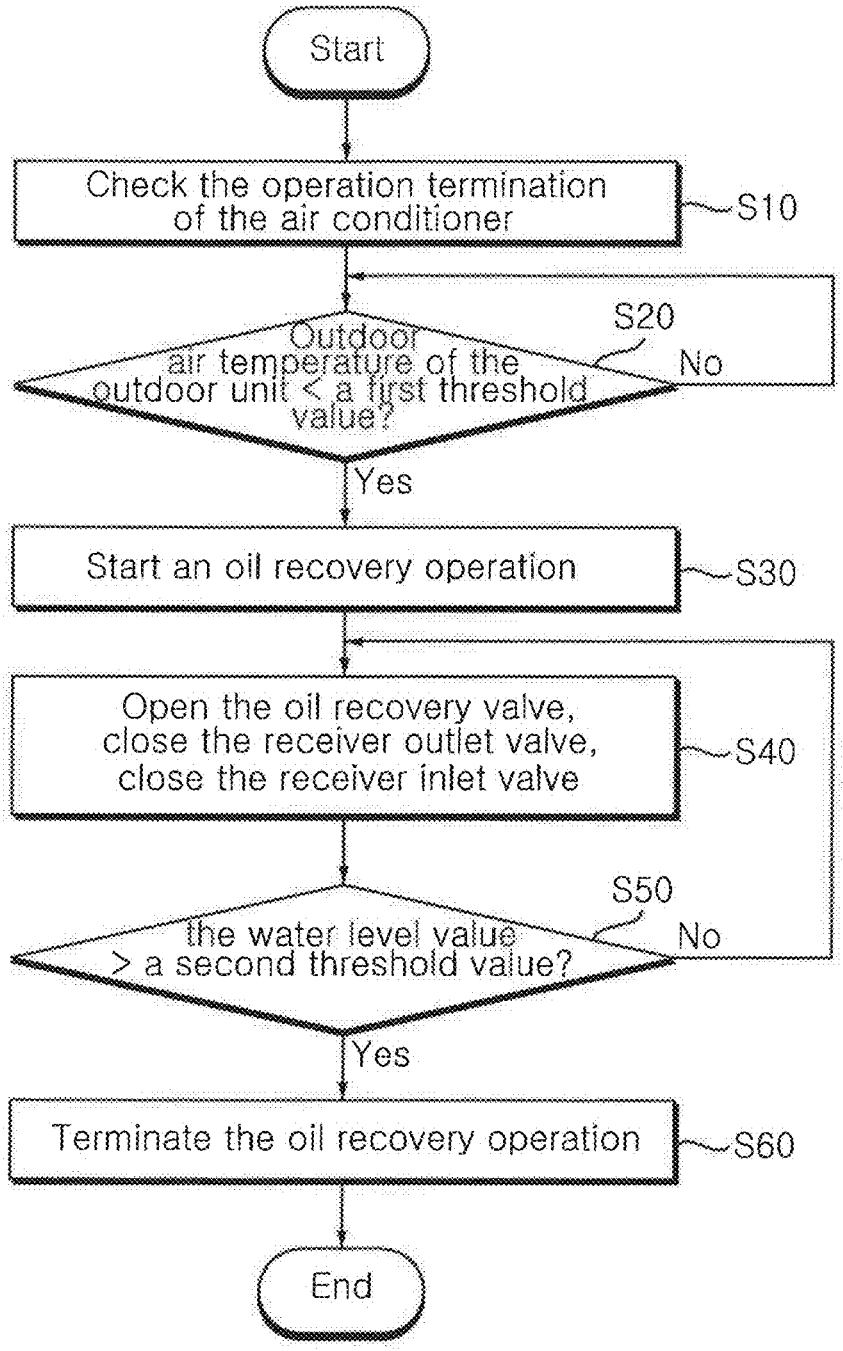
FIG. 4 is a flowchart illustrating an oil recovery operation according to a condition of the multi-air conditioner for heating/cooling operation of FIG. 2.

Referring to FIG. 4, the oil recovery operation during the heating operation in an ultra-low temperature region, i.e., a cold region, of the multi-air conditioner for heating/cooling operation of the present disclosure is actively driven regardless of user's command at the end of a corresponding operation after a user selects a specific mode to perform operation according to the outdoor state, i.e., the outdoor temperature.

In order to perform such detailed operation, the multi-air conditioner 100 for heating/cooling operation according to the embodiment of the present disclosure may include a control unit (not shown).

The control unit periodically reads the internal temperature of the indoor unit B, the external temperature of the outdoor unit A, and the oil level information of the compressor 53, receives input information such as the user's operation mode, and accordingly may perform each valve of the indoor unit B the outdoor unit A and the inverter driving of the compressor 53.

The control unit may be installed in the outdoor unit A, but, dissimilarly to this, may be implemented as a processor in a manager management system. Alternatively, a controller for performing operation according to a selected detailed mode is disposed in the outdoor unit A and a main control unit that performs a transmission/reception with the controller may be installed in a manager management system.

A detailed description of various modifications of the control unit will be omitted.

The control unit receives a simple user's operation selection command, and receives information on the current indoor temperature and outdoor temperature from the temperature sensor disposed in the indoor unit B and the outdoor unit A.

The control unit drives the inverters of each valve and compressor 53 to perform the operation of heating mode based on the received indoor and outdoor temperatures and user's operation selection information.

At this time, when the user inputs an operation termination command or a reserved time of the operation selection command is terminated, the control unit terminates both the indoor unit B and the outdoor unit A and terminates the heating operation (S10).

When the heating operation is terminated, the control unit detects and reads the outdoor air temperature of the outdoor unit A, i.e., the external temperature (S20).

When the outdoor air temperature of the outdoor unit A is lower than a first threshold value, an oil recovery operation is started (S30).

At this time, the first threshold value may be −20° C., but is not limited thereto.

When the oil recovery operation starts, the control unit closes both the receiver outlet valve 84 and the receiver inlet valve 82 while opening the oil recovery valve 86 (S40).

Accordingly, the receiver 54 serves as an oil tank. That is, when in heating mode, it is set to a low pressure by maintaining an empty state where there is no refrigerant remaining in the receiver 54, and the oil stored in the oil separator 58 and the compressor 53 that have a relatively high pressure is all recovered into the receiver 54 by opening the oil recovery valve 86.

Therefore, oil is stored in the receiver 54, and such an operation periodically reads a water level value from a water level sensor 93 in the receiver 54 (S50), and if the water level value is greater than a second threshold value, the oil recovery operation is terminated (S60).

Alternatively, when a current water level value is not different from a previous water level value after calculating the change amount of the water level value, i.e., when the pressure in the receiver 54 and the pressure in the compressor 53 become the same, the oil recovery operation is terminated.

Thus, oil can be stored to prevent an error due to oil burnout of the compressor 53 in a cold region, by automatically performing an oil recovery operation according to an external temperature after the heating operation is terminated.

Hereinafter, the heating operation after the oil recovery operation is completed will be described.

Figure 5:
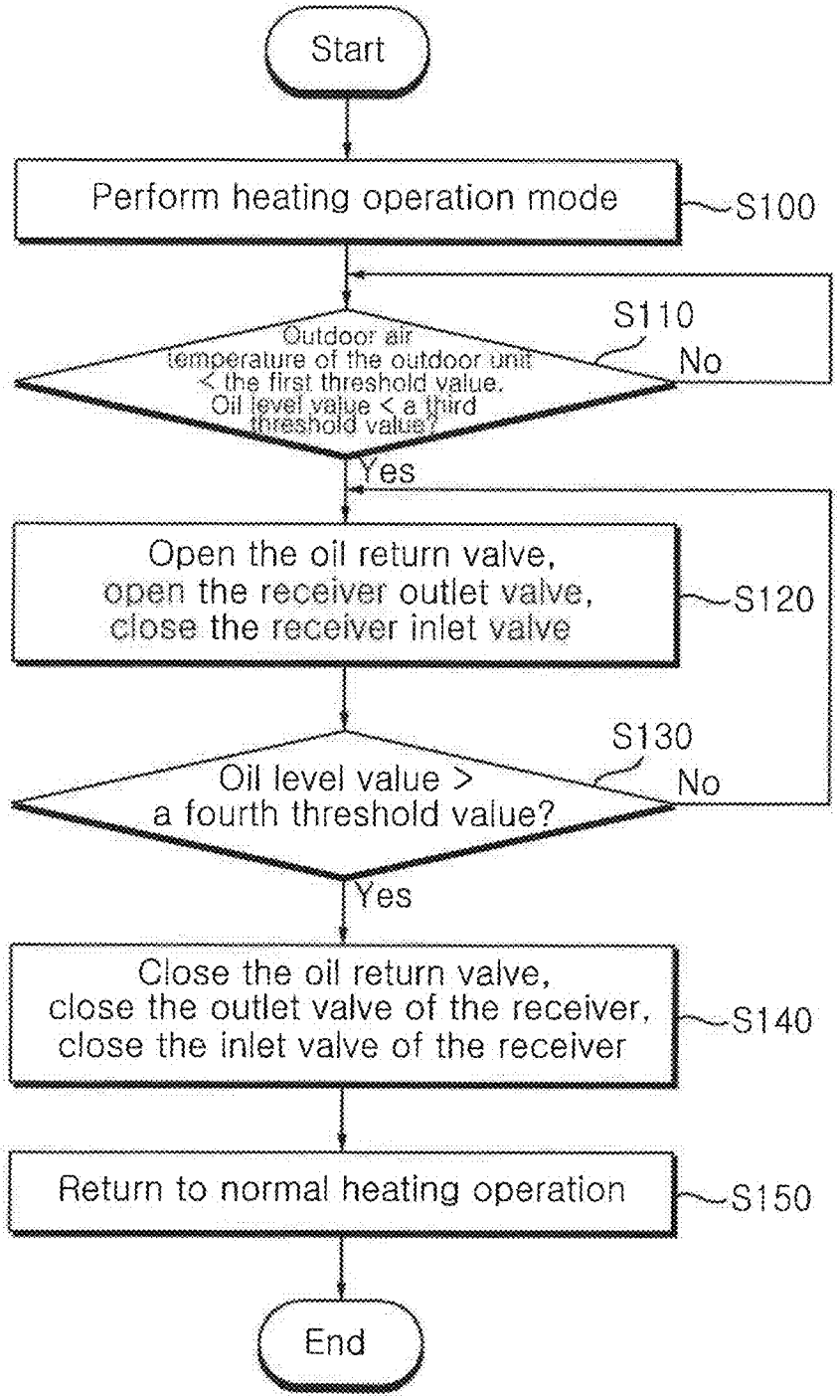
FIG. 5 is a flowchart illustrating a control during a heating operation after an oil recovery operation of the multi-air conditioner for heating/cooling operation of FIG. 4.
Figure 6:
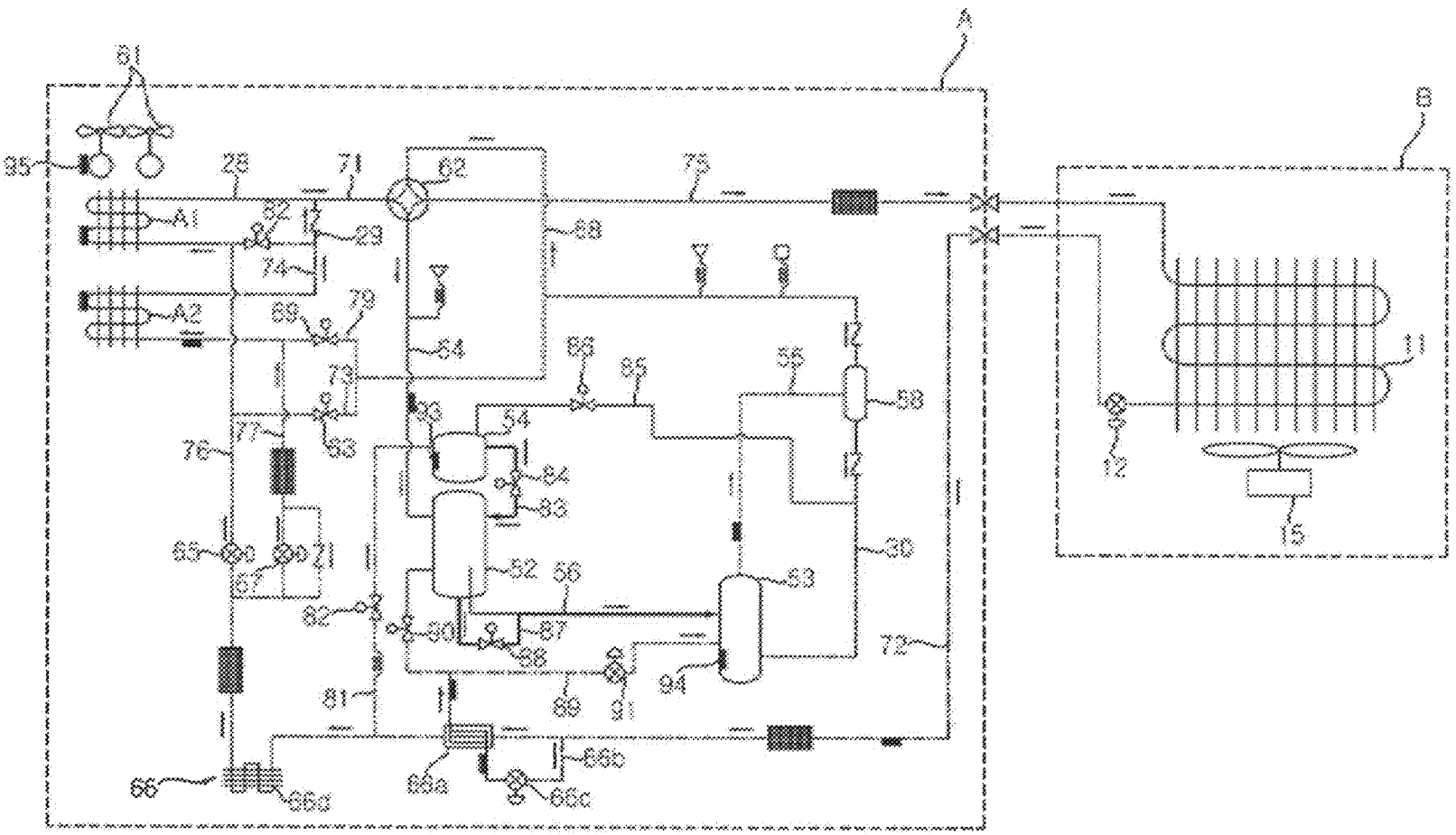
FIG. 6 is an operation diagram illustrating a heating operation after an oil recovery operation of the multi-air conditioner for heating/cooling operation of FIG. 5.

FIG. 5 is a flowchart illustrating a control during a heating operation after an oil recovery operation of the multi-air conditioner for heating/cooling operation of FIG. 4, and FIG. 6 is an operation diagram illustrating a heating operation after an oil recovery operation of the multi-air conditioner for heating/cooling operation of FIG. 5.

FIGS. 5 and 6, the control unit receives a simple user's operation selection command, and receives information on the current indoor temperature and outdoor temperature from the temperature sensor disposed in the indoor unit B and the outdoor unit A (S100).

The control unit drives the inverters of each valve and compressor 53 to perform the operation of heating mode based on the received indoor and outdoor temperatures and user's operation selection information.

At this time, the oil recovery operation is performed before the heating operation, so that oil, not the refrigerant, is stored in the receiver 54.

While starting the inverter of the compressor 53 to start the heating operation, the control unit reads the external temperature of the outdoor unit A and the oil level height information from the oil level sensor 94 of the compressor 53 (S110).

At this time, when the outdoor air temperature of the outdoor unit A is lower than the first threshold value, and the level of the oil in the compressor 53 is lower than a third threshold value, it is determined that the oil in the compressor 53 is insufficient, and the receiver 54 supplies the oil to the compressor 53 (S120).

At this time, the first threshold value may be −20° C., but is not limited thereto.

The third threshold value may be variously set according to the design of the compressor 53, but may be defined as a threshold value in which the motor of the compressor 53 cannot be operated.

The control unit closes the receiver inlet valve 82 while opening the oil return valve 88 and the receiver outlet valve 84.

By opening the receiver outlet valve 84 and the oil return valve 88, the oil in the receiver 54 is provided to the compressor 53 via the oil return valve 88 through the accumulator 52.

Accordingly, the oil level in the compressor 53 rises.

The control unit periodically reads oil level information from the oil level sensor 94 of the compressor 53, and when the oil level information is greater than a fourth threshold value (S130), closes all of the inlet and outlet valves 82 and 84 of the receiver 54, and closes also the oil return valve 88 (S140).

Accordingly, a normal heating operation is performed (S150).

At this time, the fourth threshold value is a level at which the motor and gear of the compressor 53 can operate. For example, the oil level sensor 94 may be an on/off signal generator that is turned on and transmits an on-signal when it is greater than the fourth threshold value, and is turned off and transmits an off-signal when it is equal to or less than the fourth threshold value.

Therefore, when receiving the turn-on signal from the oil level sensor 94, it is possible to convert to the normal heating mode.

In the normal heating mode, as shown in FIG. 3, both the inlet and outlet valves 82 and 84 are closed, the oil return valve 88 is also closed, and the refrigerant is received from the accumulator 52 and the refrigerant is compressed in the compressor 53.

Thus, when performing a heating operation in a cold region, an oil recovery operation for storing oil in the receiver 54 is performed to compensate for oil loss in the compressor 53. Meanwhile, the oil level in the compressor 53 is read at the start of the heating operation, and when the oil in the compressor 53 is burned out, the oil is supplied from the receiver 54.

Accordingly, the receiver 54 may serve as a refrigerant tank in the cooling operation, and serve as an oil tank in the heating operation, and may compensate the oil loss of the compressor 53 due to the low-temperature neglected operation of the outdoor unit A in a cold region.

That is, the low pressure of the entire system is slightly increased by instantaneously receiving oil from the high-pressure receiver 54 filled with oil, thereby preventing the operation interruption due to the low pressure at the start of the compressor 53.

When the oil superheat of the compressor 53 is formed by 10 degrees or more by instantaneously providing oil to the compressor 53 at the start of the heating operation, the system's oil recovery can be sufficiently achieved only by the normal operation. Therefore, the receiver 54 does not need to perform the oil supply after the oil level sensor 94 of the compressor 53 is turned on at the time of starting, but may perform the oil supply even during a heating operation by periodically receiving a signal from the oil level sensor 94.

Accordingly, the reliability of the compressor 53 is improved by performing the oil recovery operation after the heating operation without a major structural change, so that the compressor 53 can be operated without errors even in cold regions, thereby increasing the operation guarantee temperature of the air conditioner.

As described above, the present disclosure can prevent oil burnout without adding a structure by changing the usage of the receiver not used in the heating mode so as to be used as an oil storage component in the accumulator of the multi-air conditioner for heating/cooling operation using a receiver.

In addition, by performing an oil recovery operation during the heating operation in a low temperature neglected state such as in a cold region, the oil that may be insufficient can be stored in the receiver and used at the start of the next heating operation, thereby resolving the lack of oil.

In addition, the recovery operation may be actively performed according to the current state of the air conditioner by periodically checking the outdoor temperature and the compressor water level and accordingly performing the oil recovery operation.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A multi-air conditioner for heating/cooling operations, the multi-air conditioner comprising:

at least one indoor unit that performs heating/cooling operations, the at least one indoor unit comprising an indoor heat exchanger; and an outdoor unit that performs heating/cooling operations, the outdoor unit comprising a compressor, an outdoor heat exchanger, and a multiway valve disposed in a discharge side of the compressor and configured to switch a flow of refrigerant, wherein the outdoor unit comprises:

a receiver that selectively stores refrigerant or oil according to a cooling operation mode or a heating operation mode and provides the stored refrigerant or oil to the compressor:

a receiver oil recovery pipe connecting the receiver and an output terminal of the compressor; and an oil recovery valve that is disposed on the receiver oil recovery pipe and opened and closed to recover the oil in the compressor to the receiver.

2. The multi-air conditioner of claim 1, wherein the receiver stores the refrigerant in the cooling operation mode, and stores the oil in the heating operation mode.

3. The multi-air conditioner of claim 1, wherein the oil recovery valve is a solenoid valve.

4. The multi-air conditioner of claim 1, wherein the outdoor unit further comprises an accumulator that is connected to the receiver and transfers the refrigerant or oil to the compressor.

5. The multi-air conditioner of claim 3, further comprising:

a receiver outlet pipe connecting the receiver and the accumulator; and a receiver inlet pipe that transfers the refrigerant to the receiver, wherein a receiver outlet valve is provided on the receiver outlet pipe and a receiver inlet valve is provided on the receiver inlet pipe, respectively.

6. The multi-air conditioner of claim 5, wherein the receiver receives and stores the oil from the compressor in an oil recovery operation after a heating operation is terminated.

7. The multi-air conditioner of claim 6, wherein the oil recovery operation is performed only when an outdoor temperature is less than a first threshold value after the heating operation is terminated.

8. The multi-air conditioner of claim 7, wherein the first threshold value is a value lower than minus 20 degrees.

9. The multi-air conditioner of claim 8, wherein in the oil recovery operation, the oil recovery valve is opened, and the receiver outlet valve and the receiver inlet valve are closed to provide the oil of the compressor to the receiver.

10. The multi-air conditioner of claim 8, wherein an oil level sensor that senses a level of the oil is formed inside of the compressor.

11. The multi-air conditioner of claim 8, wherein the oil level sensor provided in the receiver.

12. The multi-air conditioner of claim 11, wherein when the heating operation starts, the oil of the receiver is provided to the compressor at a start of the compressor.

13. A method of controlling a multi-air conditioner for heating/cooling operation, the method comprising:

receiving a heating operation start signal;

reading an outdoor temperature and an oil level value of a compressor and determining whether the compressor is short of oil;

supplying stored oil from a receiver to the compressor to increase an oil level of the compressor, when it is determined that the oil in the compressor is insufficient;

stopping the supply of oil from the receiver and performing a heating operation, when the oil level value of the compressor is greater than a threshold value; and performing an oil recovery operation of recovering the oil to the receiver according to the outdoor temperature, when the heating operation is terminated.

14. The method of claim 13, wherein the oil recovery operation is performed, when the heating operation is terminated and the outdoor temperature is lower than a first threshold value.

15. The method of claim 14, wherein when the outdoor temperature is lower than the first threshold value and the oil level of the compressor is lower than a certain level, it is determined that the oil is insufficient, and the oil stored in the receiver is transferred to the compressor.

* * * * *